US006805658B2

(12) United States Patent
Desberg et al.

(10) Patent No.: US 6,805,658 B2
(45) Date of Patent: Oct. 19, 2004

(54) SKATEBOARD SIMULATOR

(75) Inventors: Ian Desberg, New York, NY (US); Joseph Raia, Warwick, NY (US)

(73) Assignee: Garage Manufacturing, LLC, Warwick, NY (US)

( * ) Notice: Subject to any disclaimer, the term of this patent is extended or adjusted under 35 U.S.C. 154(b) by 68 days.

(21) Appl. No.: 10/113,716

(22) Filed: Apr. 1, 2002

(65) Prior Publication Data

US 2003/0186785 A1 Oct. 2, 2003

(51) Int. Cl.[7] ..... A63B 22/16

(52) U.S. Cl. ..... 482/146; 482/148; 482/140; 482/34; 280/841; 280/600; 280/11; 280/14; 446/74

(58) Field of Search ..... 482/148, 140; 280/841, 600, 11.14; D21/224, 228; 441/74

(56) References Cited

U.S. PATENT DOCUMENTS 5,002,294 A 3/1991 Franz
5,795,277 A 8/1998 Bruntmyer
6,616,583 B1 * 9/2003 Stack ..... 482/146

* cited by examiner

*Primary Examiner*—Nichol D. Lucchesi
*Assistant Examiner*—L Amerson
(74) *Attorney, Agent, or Firm*—Schweitzer Cornman Gross & Bondell, LLP

(57) ABSTRACT

A skateboard simulator provides a stable platform for wheeled skateboard-type actions. The simulator has a pair of spaced truck-like elastomeric support means mounted to a deck to simulate the response of a conventional skateboard to user actions. Spaced contact lobe elements provide a frictional contact with the ground while flexing in response to user action to simulate the response of wheeled skateboard. The support means are preferably of a unitary urethane construction with the contact lobe element portions being of a hollow configuration.

12 Claims, 3 Drawing Sheets

2
3
30
10
2
14
3
12
16

18
18
12
14
22

20
30
26

SKATEBOARD SIMULATOR

The present invention relates to sporting goods, and particularly to a device which allows the user to simulate the action of a skateboard.

BACKGROUND OF THE INVENTION

Skateboarding as a sport has matured and developed to a point where it is now a year-round indoor and outdoor activity, with international competitions being held and with enthusiasts exhibiting the highest levels of skill. A proficient skateboarder is able to form a wide variety of tricks and stunts, which require time and effort to master. The typical learning curve incorporates falls, scrapes, and bruises to the skateboard.

A conventional skateboard comprises an elongated platform on which the skateboarder stands, positions him or herself and two pairs of wheels. In addition to serving as a source of transportation, with the user providing forward force through leg action similar to that used in propelling a scooter, the skilled skateboard enthusiast can execute leaps and skids, riding upon and over a variety of obstacles, performing jumps and other maneuvers. An explanation of the science behind skateboarding can be found at www.exploratorium.edu/skateboarding.

The conventional way for a skateboarder to practice his or her craft or learn new tricks is through trial and error. The learning curve is rendered difficult because of the very nature of the skateboard. The skateboard wheels provide a particularly unstable platform, requiring the user to maintain balance as the skateboard moves forward while attempting to master the additional actions necessary to progress. Thus, the learning process is not without physical risks. In addition, both the novice as well as the proficient skateboarder requires a large area to skateboard. A skateboard cannot be used in a small or confined area.

It is accordingly a purpose of the present invention to provide a skateboard simulator, which allows the enthusiast to develop skateboard skills and creativity without the risks and difficulties associated with conventional skateboard use.

It is a further purpose of the present invention to provide a skateboard simulator which reproduces the feel and action of a conventional skateboard.

A further purpose of the present invention is to provide a skateboard simulator which is stable and which absorbs shock and impact.

Yet another purpose of the present invention is to provide a recreational device which simulates the response of a skateboard while allowing use in confined areas.

BRIEF DESCRIPTION OF THE INVENTION

In accordance with the foregoing and other objects and purposes, the skateboard simulator of the present invention comprises a skateboard-type deck supported by a pair of resilient support truck members. The support truck members are positioned similarly to the location of conventional skateboard wheel trucks, on a conventional skateboard and are of a construction which simulates the response of a conventional wheeled skateboard to the motions and actions of the user. Each of the support truck members includes a pair of laterally-spaced support lobes. The lobes provide a non-slip contact with the ground. Preferably, the support members are of a urethane composition. The lobes may be of a hollow construction to accentuate flexure in a manner which best simulates wheeled skateboard action.

BRIEF DESCRIPTION OF THE DRAWINGS

A fuller understanding of the present invention will be accomplished upon consideration of the following, detailed description of a preferred, but nonetheless illustrative embodiment of the invention, when considered in conjunction with the annexed drawings, wherein.

DETAILED DESCRIPTION OF THE INVENTION

With reference to the Figures, the skateboard simulator 10 of the present invention comprises a deck 12, which may be of conventional skateboard deck construction and dimensions. Mounted to the bottom of the deck, and extending downwardly therefrom, are front and rear support trucks 14 and 16. The trucks may be mounted to the deck by mounting bolts and nuts 18, the accepting bores in the trucks being positioned to duplicate the bolt locations in conventional wheeled trucks, thus allowing the support trucks to be mounted on a conventional skateboard deck. The trucks may preferably be oriented on the deck to provide ground contact points having the same geometry as provided by a wheeled skateboard.

Figure 4:
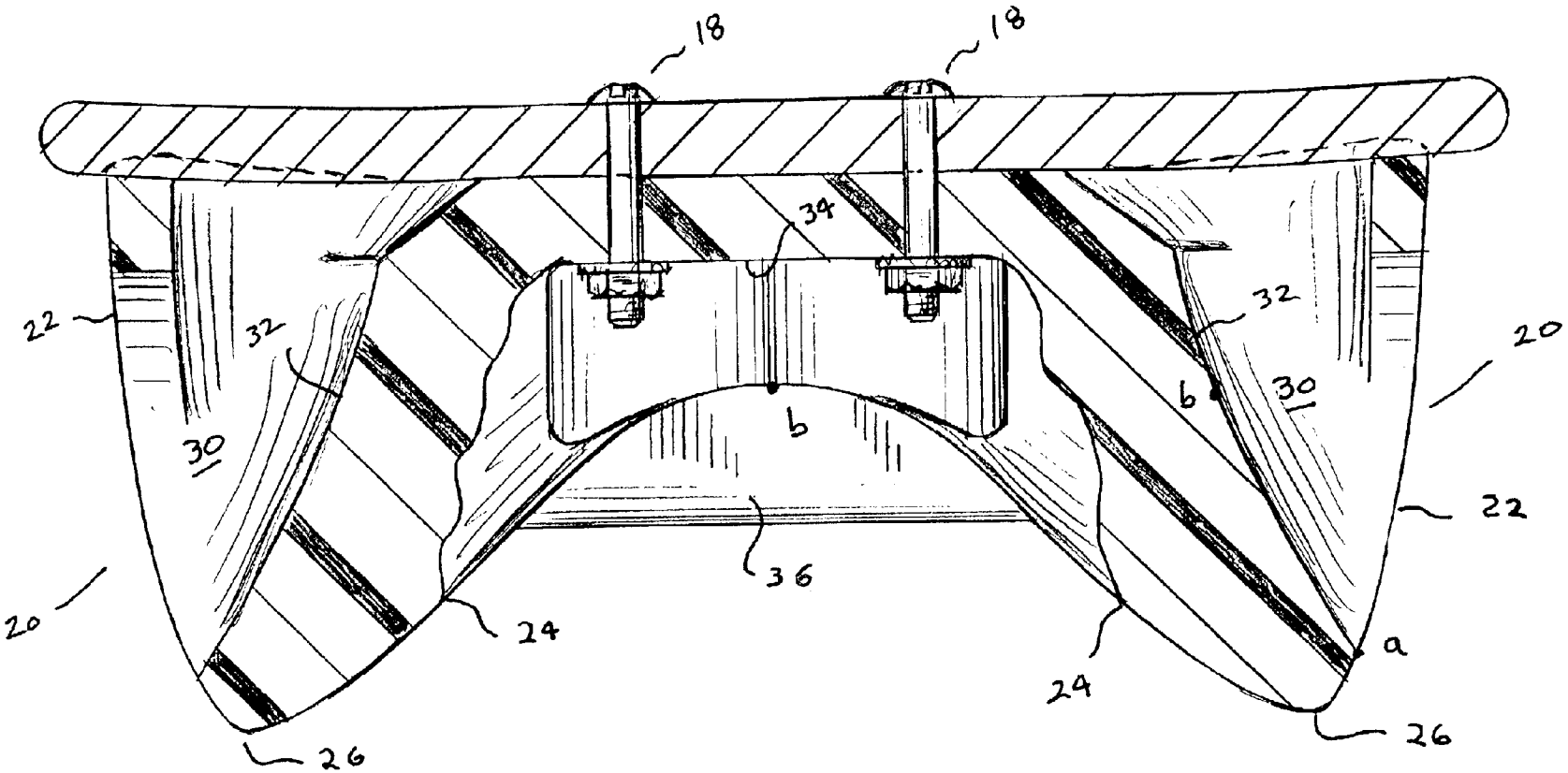
FIG. 4 is a sectional view taken along line 4—4 of FIG. 3.

As may be seen, each of the front and rear support trucks 14, 16 may be of similar construction, comprising a unitary mass of a resilient material, such as urethane plastic, which both provides controlled resiliency and flex to the actions of the skateboarder while affording a non-slip contact surface with the ground. As seen from the front, and with reference to FIG. 4, each of the support trucks comprises a laterally-spaced pair of support lobes 20, the outer walls 22 thereof being generally vertical, the inner lobe walls 24 extending inward at an angle of approximately 45°, the inner and outer walls 22, 24 merging at ground contact point 26. Thus, the two trucks provide four point ground contact simulating the spacing and stance of skateboard wheels.

Figure 1:
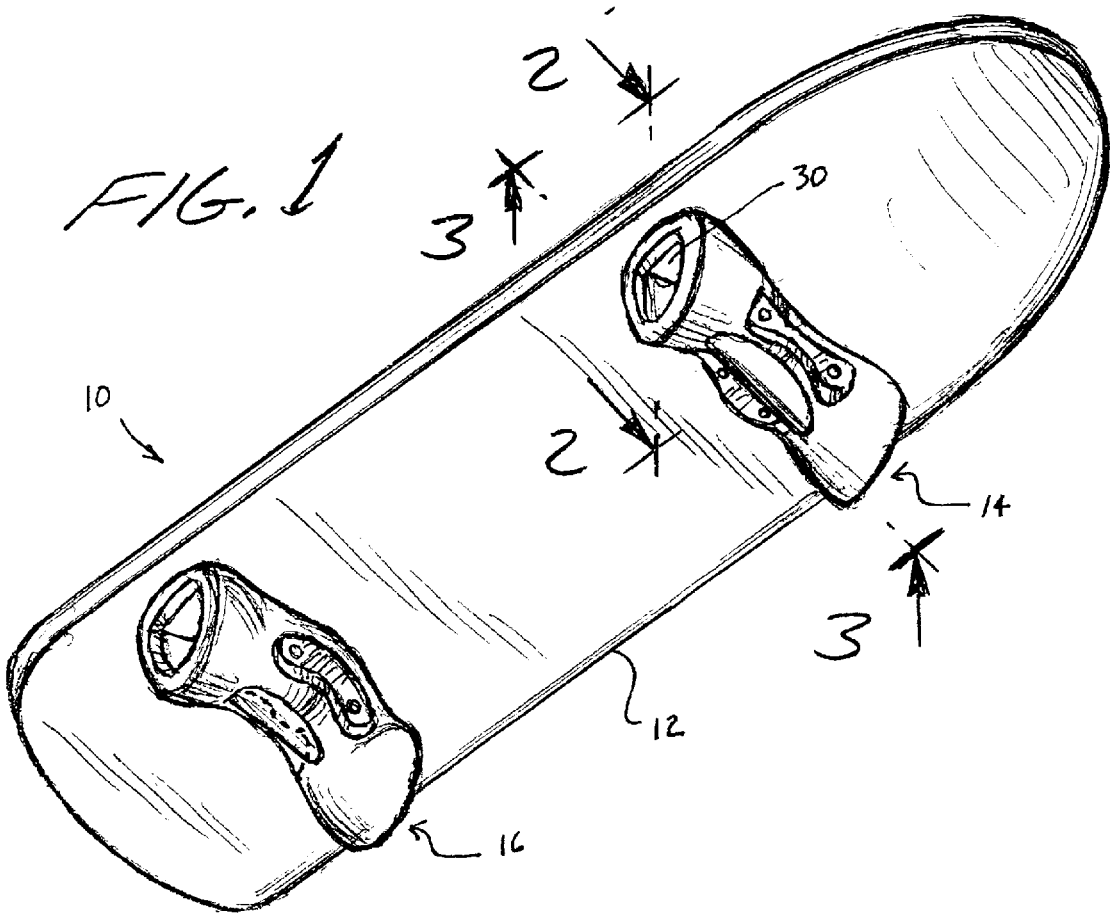
FIG. 1 is a perspective view looking upwards toward the bottom of a skateboard simulator of the invention.
Figure 2:
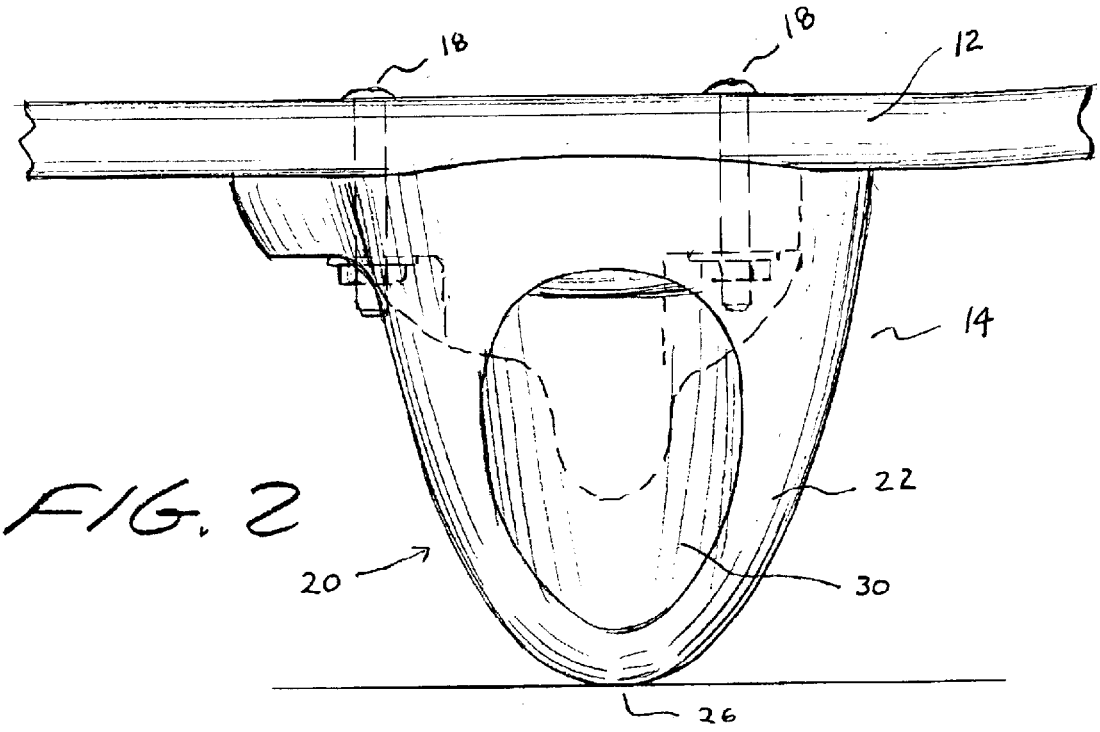
FIG. 2 is a side elevational view detailing one of the support truck members.
Figure 3:
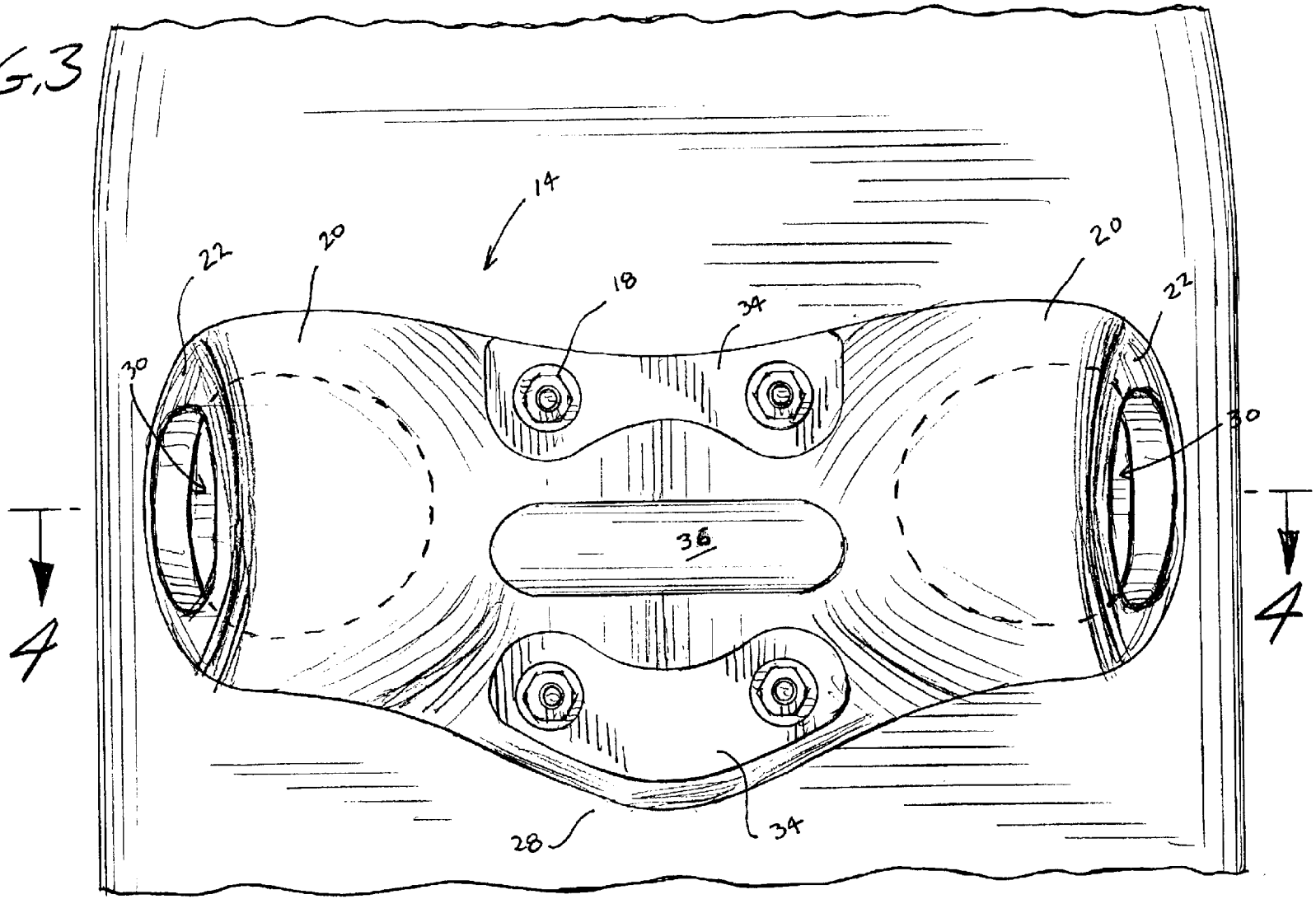
FIG. 3 is a bottom plan view looking upward along line 3—3 in FIG. 1 detailing a support truck member.

As may be seen from FIG. 3, the upper edge of each of the support trucks is of generally rectangular shape, with a bulge 28 on one side to accommodate a first pair of mounting bolts and nuts 18 and bolt bores. A pair of flat portions 34 may be formed in the truck to provide an appropriate bearing surface for the mountings. As may also be seen in this view and in FIG. 4, each of the support lobes 20 is hollow, the interior cavities 30 terminating in a generally circular exit aperture at the top surface of the support truck and tapering outward to exit through the outer lobe side walls 22. The exit aperture is generally ovate, as seen in FIG. 2. As constructed, the wall thickness surrounding the vertical aperture, which may be on the order of 2 inches long and 1.5 inches wide at its widest point, is approximately in the range of 0.3 inches at the support point 26, expanding to a thickness of approximately 0.5 inch at a height of 1.5 inches about the ground surface. As may be further seen in FIG. 4, while the sidewall 22 surrounding the vertical apertures is relatively thin, the lobe cavity 30 is backed by a substantial rear wall, ranging in thickness from about 0.9 inches at station a—a to 2.4 inches at station b—b and provides a tapered inner wall construction 32. The combination of the tapered, substantial inner wall and the wedge design for the support lobes provides controlled flex allowing the support trucks to flex in the direction shown by the arrows, thereby simulating the response of a wheeled truck skateboard.

To further provide flexibility of use and to simulate the response of a wheeled truck, a crossbar 36 may be provided between the upper portions of the support lobes. The bar is preferably formed integral with the truck construction.

In a preferred construction, the support trucks may be approximately 3 inches high, with an overall width of 7.25 inches. The support points 26 are approximately 5.9 inches apart. A urethane composition with a shore 80 rating at 72 mm has been found appropriate.

Those skilled in the art will readily appreciate that the present invention both allows the user to both practice skateboard skills in a controlled manner and provides a recreational device which simulates thee response of a wheeled skateboard without the extensive space requirements for wheeled skateboard use. Modifications and adaptations to the invention may be accomplished without departing from the scope of the invention as set forth in the annexed claims.

We claim:

1. A skateboard simulator, comprising:

a deck; and a pair of spaced elastomeric support means mounted to the deck and extending downwardly therefrom for simulating the response of a conventional skateboard to the motions of a user while preventing lateral and longitudinal motion of the simulator when the support means are in contact with the ground, the support means each comprising a pair of laterally-spaced tapered contact lobe elements projecting from a base.

2. The skateboard simulator of claim 1, wherein the support means are mounted proximate ends of the deck.

3. The skateboard simulator of claim 1, wherein each support means further comprise a crossbar adjacent the base joining the contact element.

4. The skateboard simulator of claim 1, wherein the support means are of urethane.

5. The skateboard simulator of claim 1 or claim 3, wherein the contact lobe elements have a sidewall and an interior hollow chamber.

6. The skateboard simulator of claim 5, wherein the interior hollow chamber extends through the base.

7. The skateboard simulator of claim 5, wherein the hollow chamber terminates in an aperture through the sidewall on a lateral face of the contact element.

8. The skateboard simulator of claim 7, wherein the side wall aperture is oval.

9. The skateboard simulator of claim 8, wherein the interior hollow chamber extends through the base and terminates at the base in a circular aperture.

10. A skateboard simulator, comprising:

a deck;

and a pair of spaced, elastomeric support means mounted to the deck, each having a pair of laterally-spaced lobes having a bottom contact point, tapered inner sidewall, and a generally vertical outer sidewall and an interior cavity terminating in an oval aperture through the sidewall.

11. The skateboard simulator of claim 10, wherein the outer sidewall is approximately 0.3 inches thick.

12. The skateboard simulator of claim 11, wherein the oval aperture is approximately 2 inches high.

* * * * *